United States Patent [19]

Marker et al.

[11] Patent Number: 4,528,924

[45] Date of Patent: Jul. 16, 1985

[54] SAILBOARD PROVIDED WITH FOOT-RETAINING LOOPS

[75] Inventors: Hannes Marker; Hans C. Marker; Frank P. Marker, all of Garmisch-Partenkirchen, Fed. Rep. of Germany

[73] Assignee: Hannes Marker, Garmisch-Partenkirchen, Fed. Rep. of Germany

[21] Appl. No.: 395,009

[22] PCT Filed: Oct. 29, 1981

[86] PCT No.: PCT/EP81/00172

§ 371 Date: Jun. 29, 1982

§ 102(e) Date: Jun. 29, 1982

[87] PCT Pub. No.: WO82/01525

PCT Pub. Date: May 13, 1982

[30] Foreign Application Priority Data

Oct. 29, 1980 [DE] Fed. Rep. of Germany ..... 3040764

[51] Int. Cl.[3] ..... B63B 35/72

[52] U.S. Cl. ..... 114/39

[58] Field of Search ..... 24/662, 670–680, 24/663, 602; 292/17, 18, 303; 114/39; 441/68, 70, 74, 75, 76

[56] References Cited

U.S. PATENT DOCUMENTS

| | | | |
|---|---|---|---|
| 1,009,278 | 11/1911 | Bruning | 292/17 |
| 1,372,752 | 3/1921 | Holmes | 280/614 |
| 3,235,299 | 2/1966 | Kobryner | 292/17 |
| 3,408,670 | 11/1968 | Wolfe | 441/59 |
| 3,453,013 | 7/1969 | Jeffries | 292/18 |
| 3,571,832 | 3/1971 | Rauch | 441/68 |
| 3,802,011 | 4/1974 | Castagnola | 441/75 |
| 4,028,760 | 6/1977 | Tarlton, Jr. | 441/70 |
| 4,186,690 | 2/1980 | Seiler | 24/602 |
| 4,241,929 | 12/1980 | Curry | 441/68 |

FOREIGN PATENT DOCUMENTS

| | | | |
|---|---|---|---|
| 28801 | 5/1981 | European Pat. Off. . | |
| 988917 | 5/1955 | France | 292/17 |

*Primary Examiner*—Sherman D. Basinger
*Assistant Examiner*—Edwin L. Swinehart
*Attorney, Agent, or Firm*—Fleit, Jacobson, Cohn & Price

[57] ABSTRACT

A sailboard is provided with foot-retaining loops, which are made of flexible and/or elastic material and at their ends are secured to the board. In order to ensure a reliable release also in the case of twisting falls, at least one end of the foot-retaining loops is connected to the sailboard by a snap fastener, which can be opened by tension and/or torsion and/or a transverse displacement.

3 Claims, 38 Drawing Figures

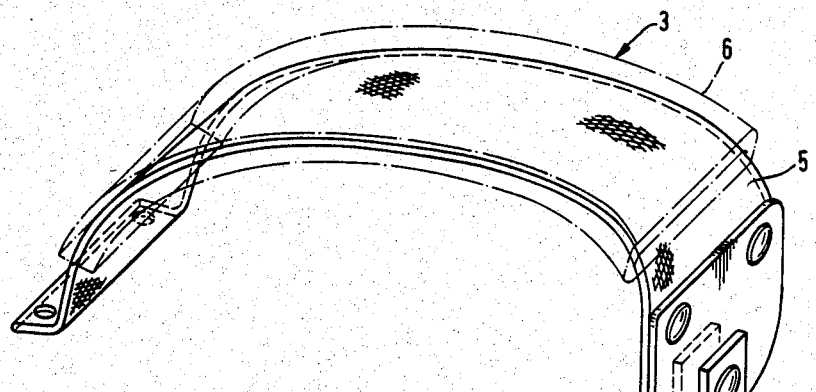
FIG. 7
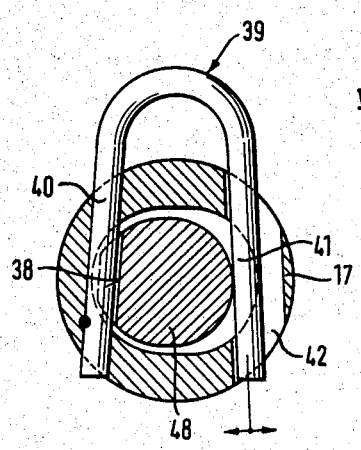
FIG. 8
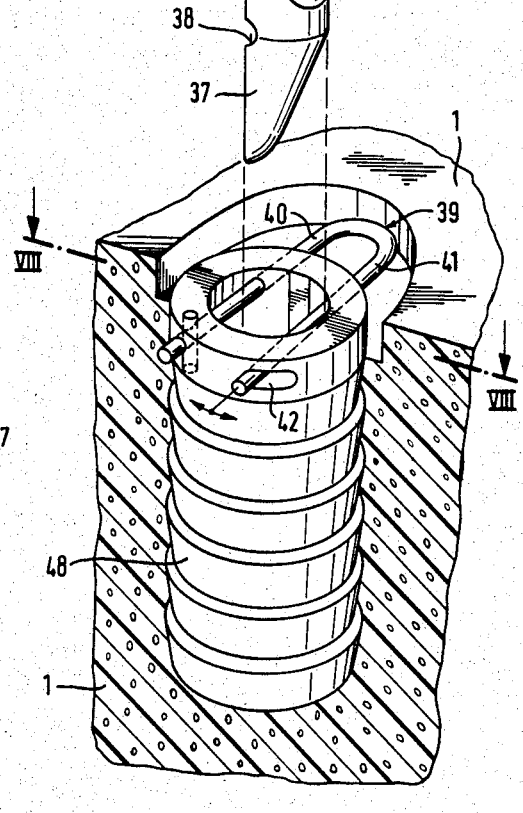

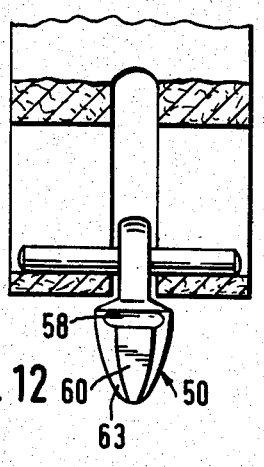
FIG. 12
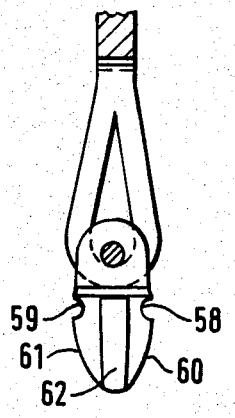
FIG. 13
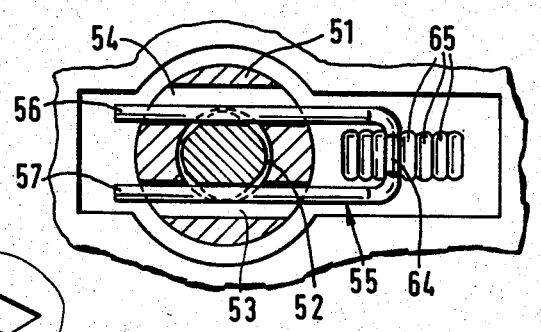
FIG. 15
FIG. 14
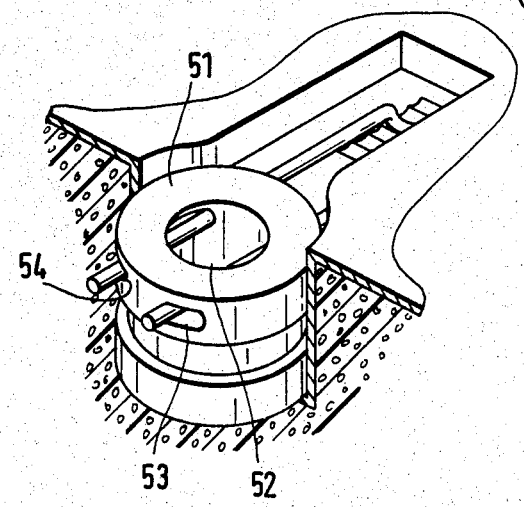
FIG. 16
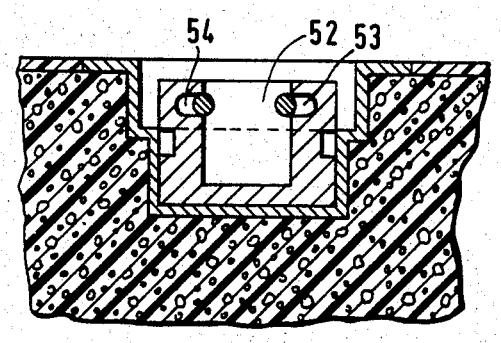

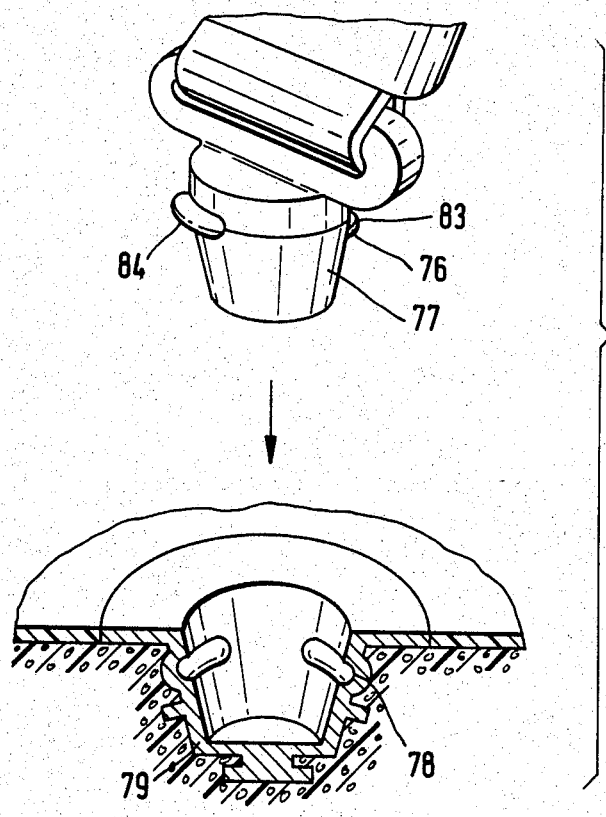
FIG. 19
FIG. 20
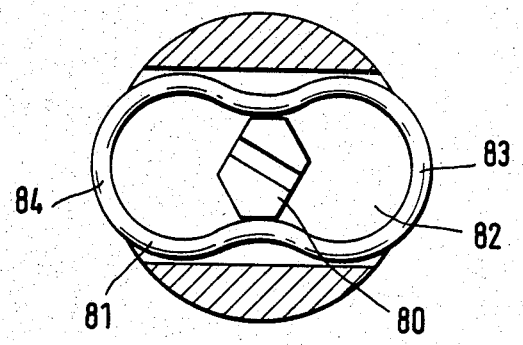

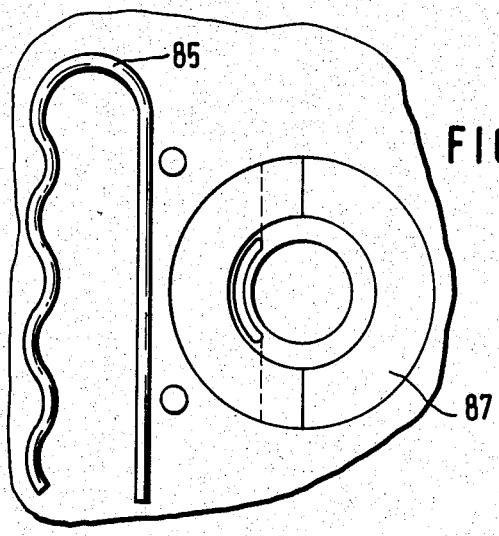
FIG. 21
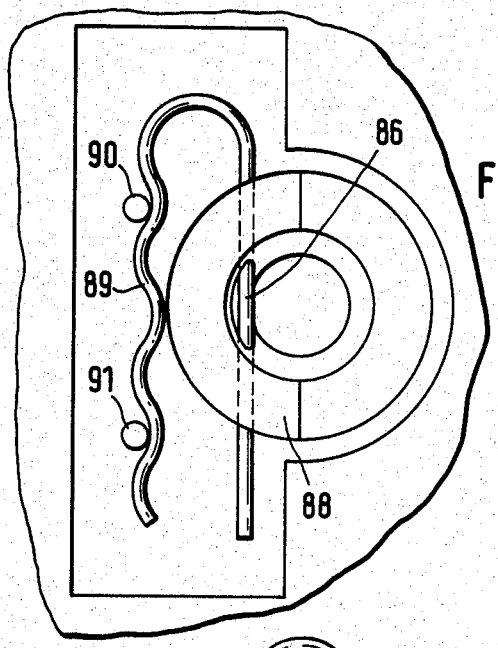
FIG. 22
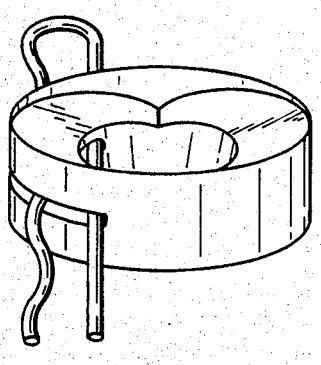
FIG. 23
FIG. 24
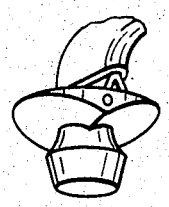
FIG. 25
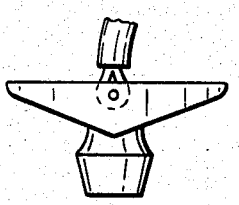
FIG. 26
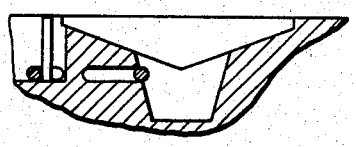
FIG. 27
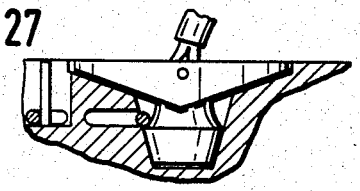
FIG. 28
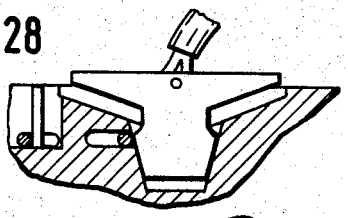
FIG. 29
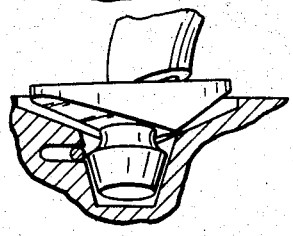

SAILBOARD PROVIDED WITH FOOT-RETAINING LOOPS

This invention relates to a sailboard provided with foot-retaining loops made of flexible and/or elastic material and having ends secured to the board.

A sailboard having foot-retaining loops which serve to prevent a slipping of the surfer from the board particularly at high speeds or in surfriding is known, e.g., from laid-open German Application No. 29 21 372. In order to prevent a catching of the surfer in the foot-retaining loops in case of a fall, the foot-retaining loops of the known sailboard consist of two parts, which are connected by a buckle and may overlap at the joint.

To ensure that the surface can safely leave the sailboard in case of a twisting fall, the foot-retaining loops may be secured to turntables.

Foot-retaining loops consisting of two parts afford a less secure hold to the surfer. Foot-retaining loops which are secured to turntables involve an expensive structure and do not ensure under all circumstances that the foot will be released.

For this reason it is an object of the invention to provide a sailboard with foot-retaining loops which afford a secure hold to the surfer and ensure a release also in case of twisting falls.

In a sailboard provided with foot-retaining loops of the kind described first hereinbefore this object is accomplished according to the invention in that one end is fixedly connected to the sailboard and the other end is connected to the sailboard by a snap fastener which opens in response to tension and/or torsion.

The releasable end may be provided with an eye and a resilient tongue may be provided for resiliently holding the eye against a camlike projection, which extends at least partly through the tongue and has oblique and/or curved run-up surfaces. Such a snap fastener will release the one end of the foot-retaining loop when the same is subjected to tension as a result of a fall or is rotated by a foot which has been caught. In response to tension or torsion or to a combined stress the eye will slide over the camlike projection and will force back the resilient tongue so that the snap fastener will release the one end of the foot-retaining loop in response to an excessively high stress.

Instead of a resilient tongue, a platelike element may be used to hold the eye against the oblique or curved detent projection. A device for varying the initial stress of the resilient element is suitably provided so that the force required to release the foot-retaining loops can be adjusted to the individual requirements of the surfer.

According to another development of the invention, the releasable end of the foot-retaining loop may be provided with a plug-in member, which has a groove or aperture and is adapted to be releasably locked by a resilient element in a bushing, which is anchored in the sailboard, and said resilient element grips the plug-in member between a projection, which extends into the groove or aperture, and the opposite side of said projection. The snap fastener can be opened by tension and by a turning movement under tension. The plug-in member is suitably substantially circular in cross-section and is provided with a detent groove only on one side so that even during a rotation of the detent member the detent groove will be released from the projection which has snapped into said groove.

Advantageous further developments of the invention have been described in the dependent claims.

Illustrative embodiments of the invention will now be explained more in detail with reference to the drawing, in which FIG. 1 is a fragmentary sectional view showing a sailboard and taken on a plane which extends along one embodiment of a foot-retaining loop, one end of which is secured to the sailboard by a separable snap fastener.

FIG. 7 is a perspective view showing a sixth embodiment of a snap fastener for foot-retaining loops.

FIG. 8 is a sectional view taken on line VII—VII in FIG. 7.

FIG. 12 is a side elevation showing the detent pin having beveled edges.

FIG. 13 is an end view showing the detent pin of FIG. 12.

FIG. 14 is a perspective view showing the detent pin of FIGS. 12 and 13 and the associated retaining bushing.

FIG. 15 is a top plan view showing partly in section the retaining bushing of FIG. 14.

FIG. 16 is a longitudinal sectional view showing the retaining bushing of FIG. 14.

FIG. 19 is a detent pin and associated detent bushing and a detent spring secured to the detent pin.

FIG. 20 shows an annular spring having an adjustable release hardness.

FIGS. 21 to 23 show detent bushings and resilient legs which extend through said bushings and are longitudinally displaceable to adjust their spring force.

FIGS. 24 to 29 show a detent pin, which has the shape of a mushroom head, as it is inserted into the detent bushing, in the retaining position and during the release.

Figure 1:
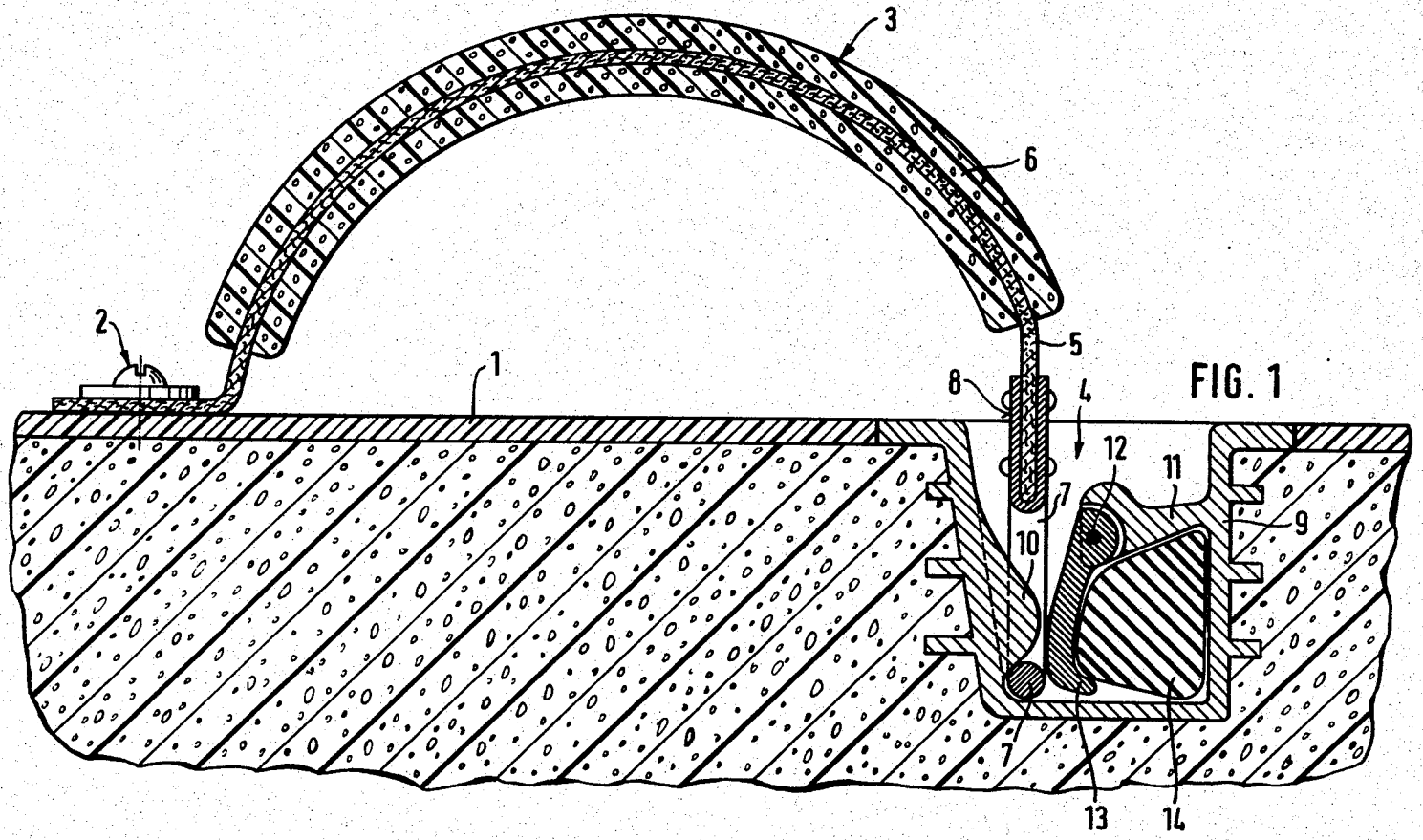

In all embodiments of the foot-retaining loops which are shown in the drawings, one end of the loop is fixedly secured to the sailboard 1, e.g., by a screwed joint 2, which is shown in FIG. 1, and the other end of the foot-retaining loop 3 is secured to the sailboard 1 by a snap fastener 4, which opens in response to tension or torsion. The foot-retaining loop 3 consists of a flexible belt 5, which may be woven, and which is covered by padding material 6, for instance, a tubing of foamed rubber.

A metal member 8 is riveted to the releasable end of the belt 5 and provided with an annular eye 7. The eye 7 is releasably locked in a bushing 9, which is flush with the sailboard 1 and anchored to the latter. The bushing 9 is provided at its left-hand end wall with a camlike projection 10, which is shaped like a drop. A retaining web 11 is provided on the opposite wall of the bushing 9. A tongue 13 is pivoted to the retaining web 11 on a pivot 12. A rubber block 14 is gripped between the tongue 13 and the wall and resiliently urges the tongue 13 against the projection 10. The tongue 13 and the projection 10 define wedge-shaped spaces, which taper to the uppermost point of the projection, so that the eye 7 can be forced from above into the space between the resilient tongue 13 and the projection 10 until the eye resiliently snaps behind the projection 10. When tension is exerted on that end of the belt 5 which is provided with the eye 7, the latter will force back the tongue 13 and will slide over the uppermost point of the projection 10 so that the eye 7 is released.

The resilient tongue 13 will also be forced back against the force of the rubber block by the eye 7 when the latter is subjected to torsion.

Figure 2:
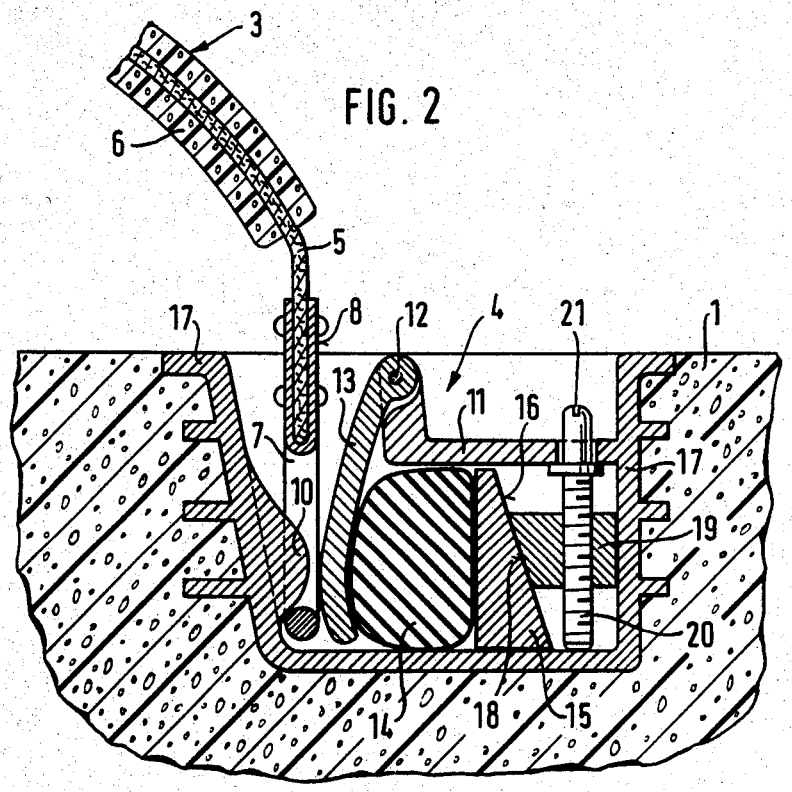
FIG. 2 is a sectional view showing the snap fastener which is provided at one end of a foot-retaining loop and has a variable retaining force.

In the embodiment of the detent lock which is apparent from FIG. 2, the rubber block 14 bears on a pressure-applying member 15, which has a wedge surface 16 and is guided by and transversely displaceable in the bushing 7. The wedge surface 16 of the pressure-applying member 15 lies against the wedge surface 18 of an adjustable block 19, which has female screw threads in threaded engagement with the screw 20. The latter has a slot 21 for the actuation of the screw with a screwdriver.

Figure 3:
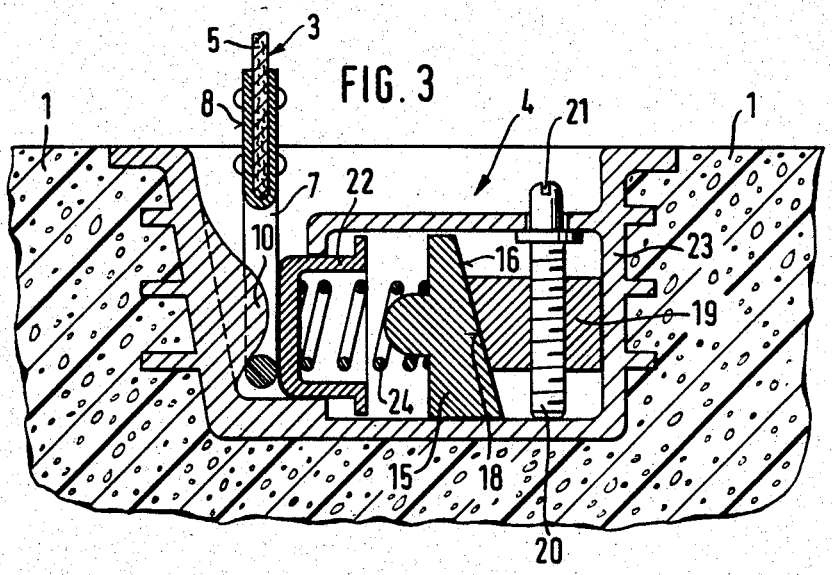
FIG. 3 is a sectional view showing a third embodiment of a snap fastener which is used with a foot-retaining loop and has a variable retaining force.

In the embodiment shown in FIG. 3, the eye 7 is forced against the cam-shaped projection 10 by the end face of the sleeve 22. The sleeve 22 is guided by and transversely displaceable in the bushing 23. The inner end wall of the sleeve 22 constitutes the abutment for one end of the compression spring 24, the other end of which bears on a block which is adjustable by a screw.

Figure 4:
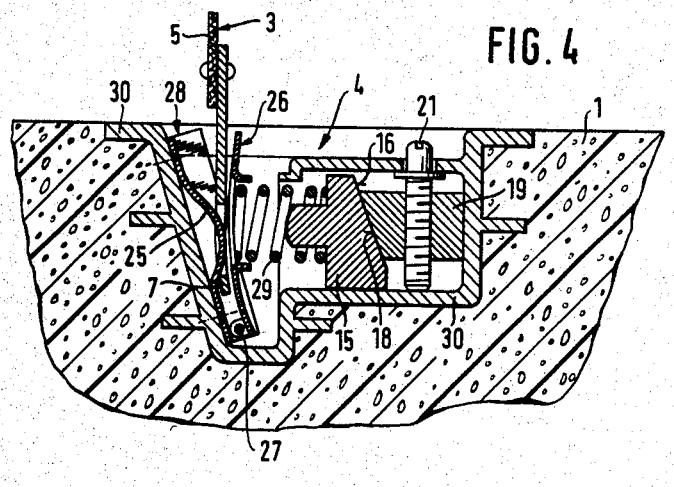
FIG. 4 is a sectional view showing a fourth embodiment of a snap fastener which is used with a foot-retaining loop and has a variable locking force.
Figure 5:
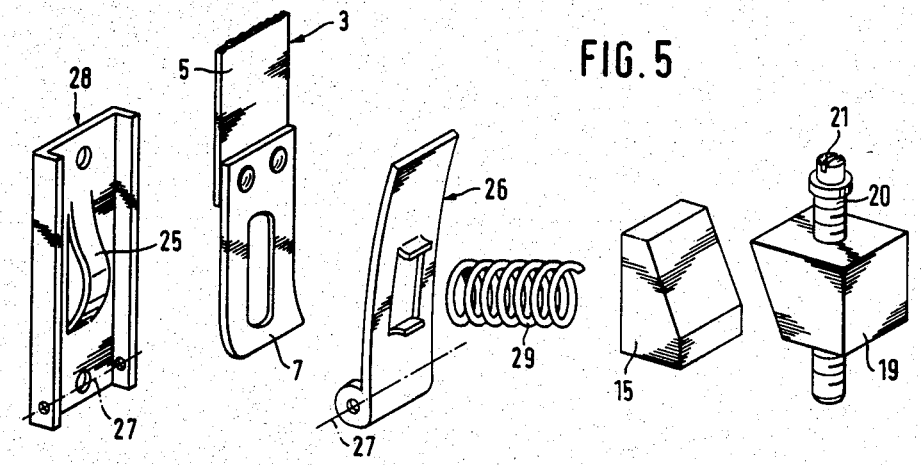
FIG. 5 is an exploded view showing the essential parts of the snap fastener of FIG. 4.

In the embodiment shown in FIG. 4, the projection 25 has been bent from a sheet metal element 28, which has legs, to which the tongue 26 is pivoted on the pivot 27. The sheet metal element 28 and the tongue 26 together constitute a tonglike insert, which is secured in the bushing 30. In the manner which is apparent from FIGS. 4 and 5 the tongue 26 is forced against the projection 25 by the spring 29, which has a variable initial stress.

Figure 6:
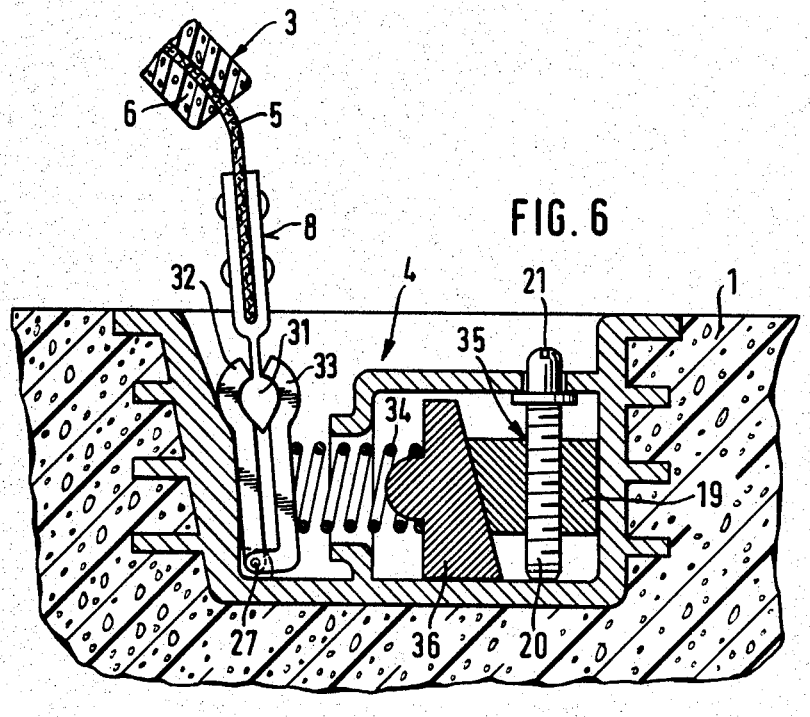
FIG. 6 is a sectional view showing a fifth embodiment of a snap fastener for foot-retaining loops.

In the embodiment of the snap fastener which is shown in FIG. 6, the releasable end of the belt 5 is provided with an enlarged head 31, which is releasably locked between a correspondingly shaped retaining arm 32 and a pivoted arm 33 as by tongs. The retaining force is exerted by the compression spring 34, which bears at one end on the pivoted arm 33 and at the other end on the pressure-applying member 26, which is displaceable by the screw 35.

Figure 9:
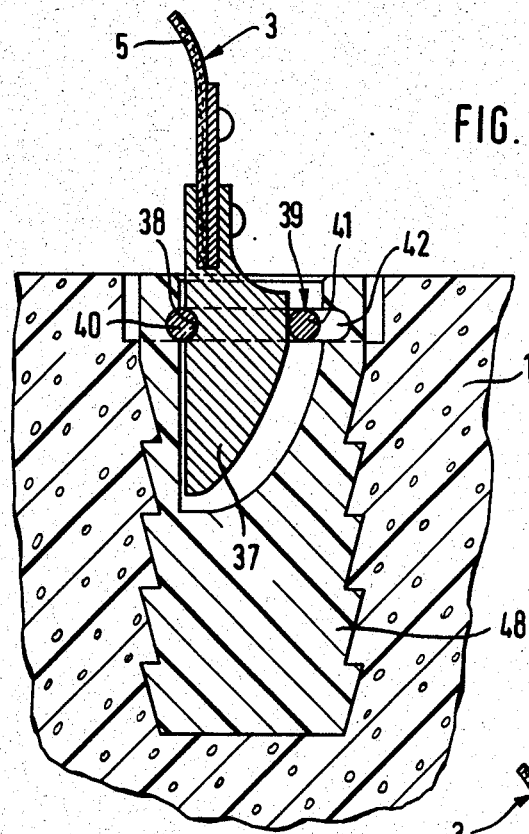
FIG. 9 is a longitudinal sectional view showing the detent bushing and the plug-in member locked therein.
Figure 10:
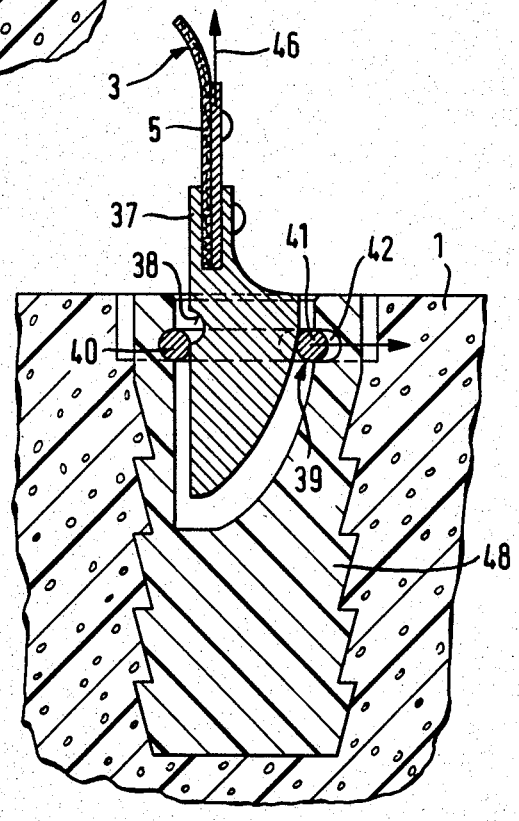
FIG. 10 is a view that is similar to FIG. 9 and shows the condition at the time when the plug-in member is released by the detent bushing.

In the embodiment of the snap fastener which is apparent from FIGS. 8 to 10, the belt 5 is provided with a plug-in member 37, which has the shape of a rounded cone that is flattened on one side. The insert is formed with a groove 38 on the flattened side.

The insert 37 is slidable into the bushing 48, which is anchored in the sailboard 1 and which at its top end carries a spring 39, which is curved like a hairpin. The leg 40 of the spring 39 is secured in bores of the bushing 48 in such a manner that said leg protrudes into the interior of the bushing 48. The other leg 41 of the hairpin-shaped spring 39 is freely resiliently movable in slots 42 formed in the bushing 48. As the plug-in member 37 is forced into the bushing 48, it is held between the legs 40, 41 of the spring 39 in the manner which is apparent from FIG. 10. As the plug-member 37 is inserted, it forces the legs of the spring apart until the leg 40 snaps into the groove 38 of the plug-in member 37. In response to tension exerted on the plug-in member in the direction of the arrow 46, the leg 41 will yield resiliently to release the plug-in member 37.

In response to a twisting of the belt 5 of the foot-retaining loop, the plug-in member 37 will be rotated and the side edges of the plug-in member will sufficiently force apart the legs of the spring 39 so that the plug-in member 37 is also released.

Figure 11:
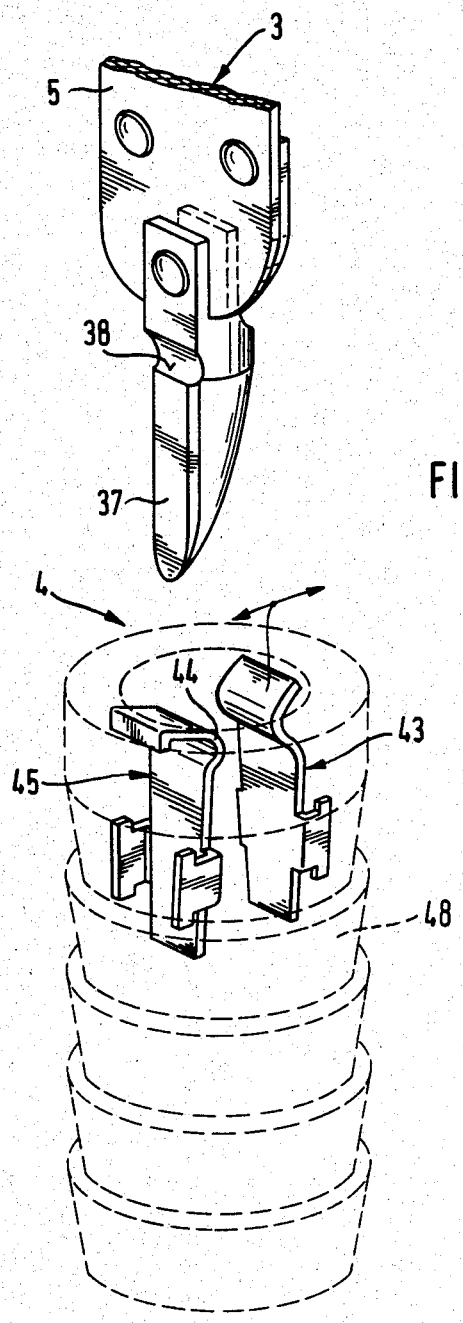
FIG. 11 is a perspective view showing a modification of the detent lock of FIG. 7.

The illustrative embodiment shown in FIG. 11 differs from that shown in FIGS. 8 to 10 essentially only by the provision of a leaf spring 43, which in snapped-in condition forces the groove 38 of the plug-in member 37 against the bead-shaped edge portion 44 of a retaining sheet metal element 45.

An approximately pyramid-shaped detent pin 50 and an associated detent bushing 51 is shown in FIGS. 12 to 16. The bushing has an axial bore 52, in which the detent pin 50 can be releasably locked by a pin 55 which is curved like a hairpin. The legs 56, 57 of the hairpin-shaped spring 55 extend through slots 53, 54 of the bushing 51 so that the legs 56, 57 bear on the inner edges of the slots 52, 53 and protrude into the axial bore 52 of the bushing 51.

The detent pin 50 is formed on opposite sides with parallel detent recesses 58, 59 and is formed on opposite sides with curved surfaces 60, 61, which extend as far as to the detent recesses 58, 59. Between the detent recesses 58, 59, the detent pin has sliding surfaces 62, which extend upwardly beyond said recesses. Oblique surfaces 63 are provided between the surfaces 60, 61, on the one hand, and the surfaces 62, which extend to a higher level, on the other hand. In response to a turning of the detent pin the oblique surfaces 63 lift the resilient legs 56, 57 out of the detent recesses 58, 59 to promote a release in response to torsion or to torsion and tension.

To permit a variation of the spring force of the resilient legs 56, 57, the web 64 which connects the legs may be caused to snap into detent grooves 65, as is shown in FIG. 15, so that the effective resilient length of the legs can be varied in accordance with the desired release hardness.

Figure 17:
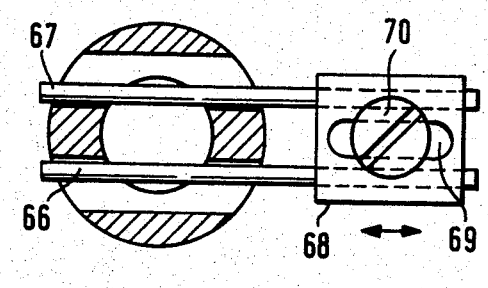
FIG. 17 is a transverse sectional view showing a different embodiment of a retaining bushing with longitudinally displaceable, resilient legs extending through that bushing.

In the embodiment shown in FIG. 17, the resilient legs 66, 67 are secured in a retaining member, which has a slot 69 and is screwed to the sailboard or a retaining device by a screw 70. When the screw 70 is released, the retaining member can be moved in the directions of the double-headed arrow. The screw 70 can then be tightened to hold the retaining member in the desired position.

Figure 18:
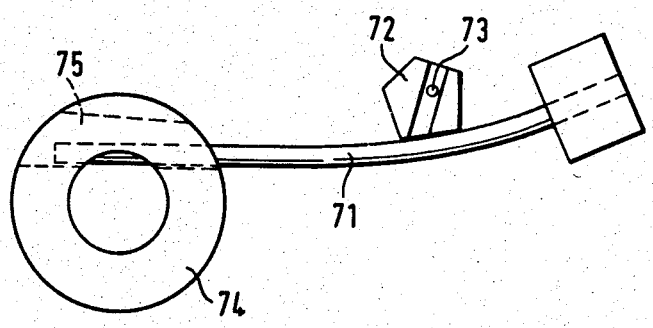
FIG. 18 shows a detent pin and an associated retaining bushing, which contains a resilient leg having an adjustable spring force.

In the embodiment shown in FIG. 18, the resilient leg 71 is acted upon by a rotatably mounted camwheel 72, which has bearing side faces, which are increasingly spaced apart from the shaft 73 of the camwheel. The camwheel can be rotated to vary the spring force of the leg 71, which extends through the slot 75 of the detent bushing 74.

In the embodiment shown in FIG. 19 the detent spring 76 is secured to the detent pin 77 so that the detent spring 76 can enter grooves or detent recesses 78 of the detent bushing 79. FIG. 20 is a sectional view showing the detent pin of FIG. 19. The camwheel 80 may be used to adjust the hardness of the annular spring 81, which is mounted in a slot 82 extending through the detent pin. The spring 81 is so arranged that the end faces 81, 84 of the spring protrude from the slot.

A pin 85 having the shape of a hiarpin is shown in FIGS. 21 to 23 and has one leg 86 that extends through a slot 88 of the detent bushing 87 and another leg 89, which is undulated so that it can be held behind pins 90, 91, which are secured to the sailboard.

A detent pin having the shape of a mushroom head is apparent from FIGS. 24 to 29 and can be resiliently locked by being inserted into the detent opening of the detent bushing 87.

Figure 30:
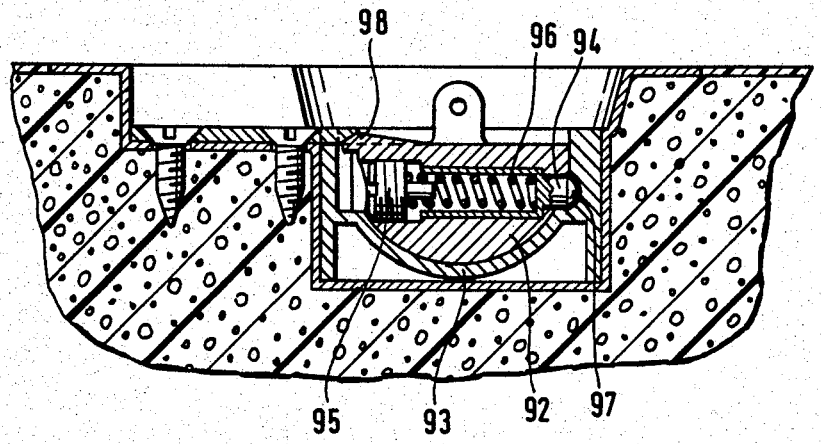
FIGS. 30 and 31 show a spherical detent pin having a detent recess in the shape of a segment of a sphere.
Figure 31:
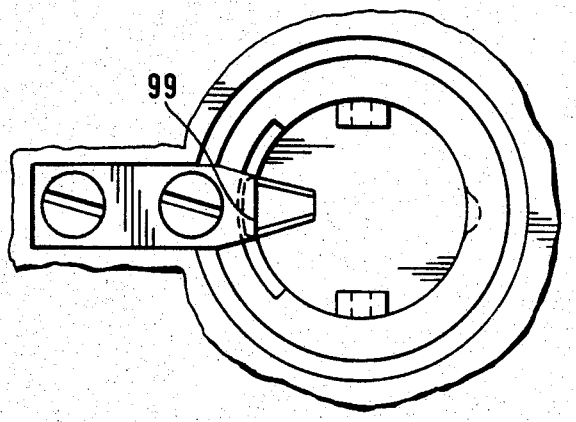

FIGS. 30 and 31 show a semispherical detent pin 92, which cooperates with a bowl 93, which has the shape of a segment of a sphere and constitutes the detent bushing. The spherical detent pin 92 has a transverse bore, from the forward end of which a detent pin 94 protrudes. The bore is closed by a screw-threaded plug 95. A compression spring 96 is held under initial stress between the detent pin 94 and the screw-threaded pin 95. The detent bushing 93 has a detent recess 97 for the detent pin 94.

A nose 99 formed on the top rim of the detent bushing or of the detent member extends over and contacts a nose 98 of the spherical detent pin.

Figure 32:
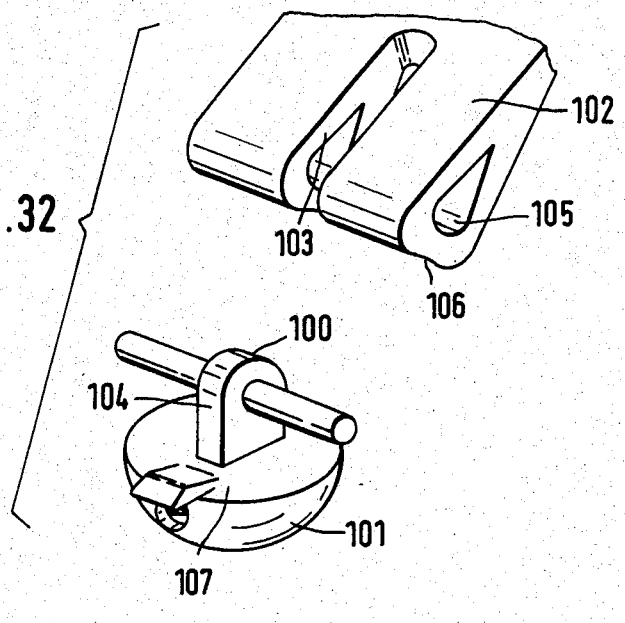
FIGS. 32 to 34 show a forked end portion of a foot-retaining loop and an eye to be mounted on the T-shaped head of a detent pin.
Figure 33:
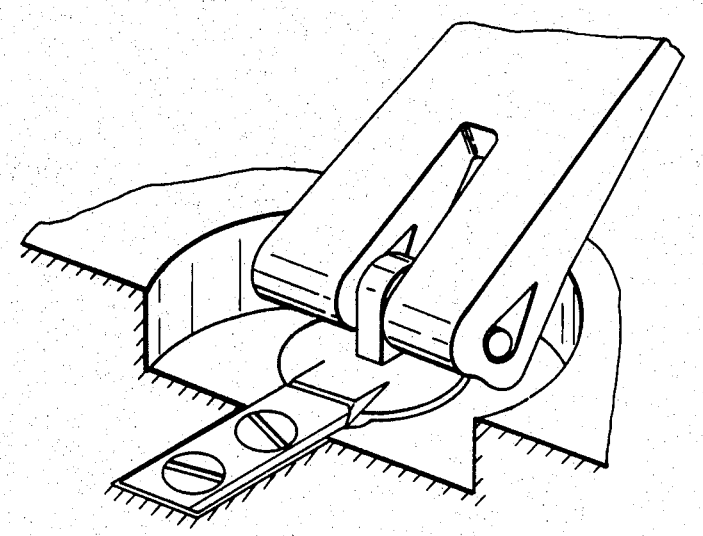
Figure 34:
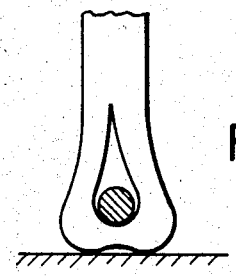

In the embodiment shown in FIGS. 32 to 34, the forked end of the foot-retaining loop is secured to the T-shaped head member 100 of the hemispherical detent pin 101. The foot-retaining loop 102 is extruded from elastomeric material and has at its end a slot 103 which is as wide as the web 104 of the retaining member 100. A transverse bore 105 extends through the forked end of the foot-retaining loop 102 so that the end can be applied to the T-shaped retaining member 100 when the slot 103 is expanded.

The end face 106 of the end of the foot-retaining loop is flattened so that said end can bear in such a manner on the flat rear face 107 of the detent pin 101 that the end of the foot-retaining loop is approximately vertical.

Figure 35:
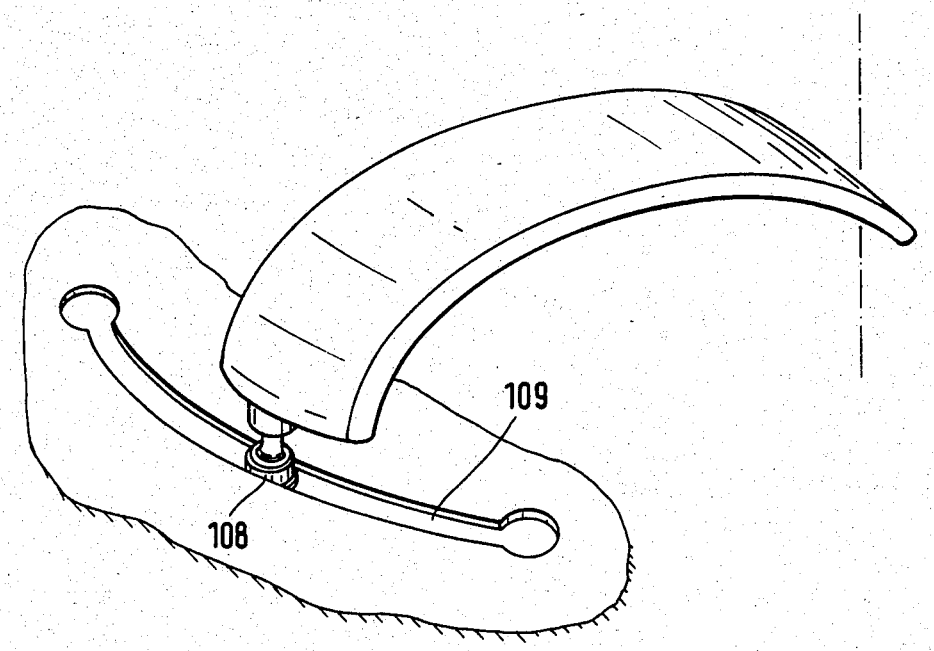
FIG. 35 shows how one end of a foot-retaining loop is secured in a cam slot of the sailboard.

FIG. 35 shows an embodiment in which the detent pin 108 is guided in a guiding slot 109, which is formed on the sailboard. The slot 109 is slightly curved and at its ends has bores which are larger in diameter than the head of the detent pin 108 so that the detent pin can emerge from the cam slot adjacent to said bores. Springs are provided on both sides of the detent pin and tend to hold the detent pin approximately in the central portion of the guide 109.

Figure 36:
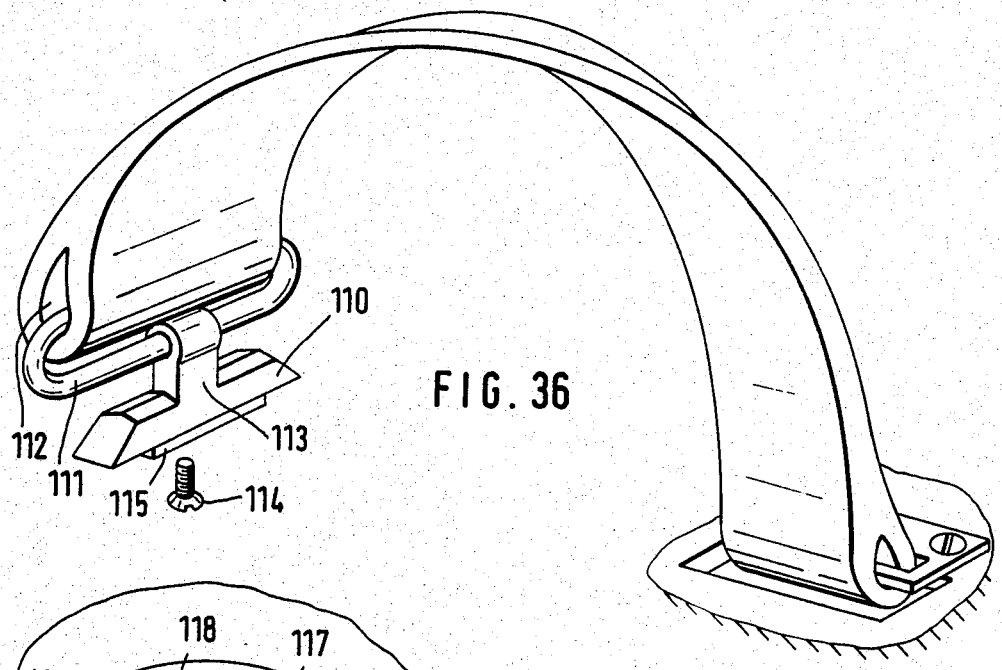
FIG. 36 is a perspective view showing a foot-retaining loop which at its releasable end is provided with a locking block of elastomeric material.
Figure 37:
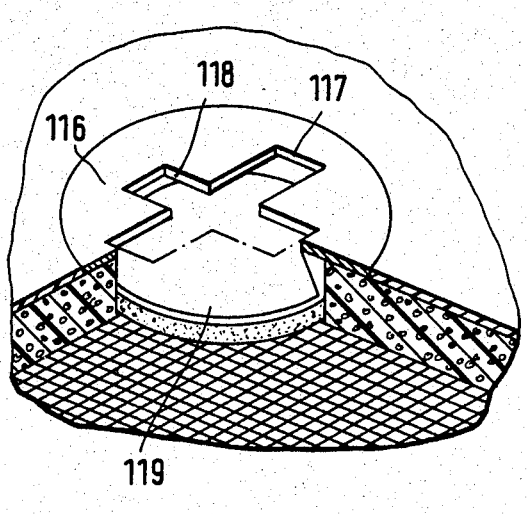
FIG. 37 shows partly in section a locking bushing which is flush with the sailboard and has crossing slots.
Figure 38:
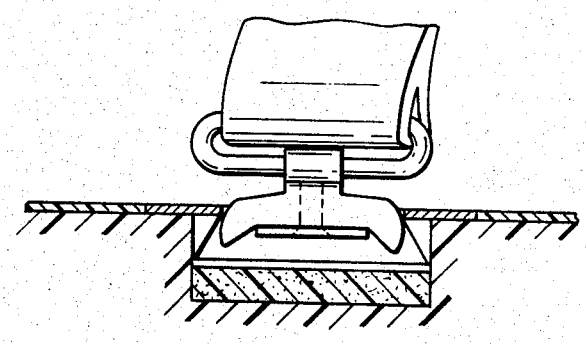
FIG. 38 is a sectional view showing the locking bushing of FIG. 37 and the inserted locking block during its release.

In the embodiment shown in FIGS. 36 to 38, the releasable end of the foot-retaining loop carries a locking block 110, which is connected by a flat ring 111 to the eye 112 at the end of the foot-retaining loop. The locking block 110 has substantially the shape of a parallelepiped and its narrow end faces are upwardly inclined toward each other from its rectangular bottom and constitute wedge-shaped ramps. The top of the locking block slopes like a roof. The locking block 110 has a middle fixing web 113 and is connected by the latter to the flat retaining ring 111. For stiffening the locking block 110, a metal member is embedded therein and has at its top end a bore, through which the ring 111 extends. The metal member is provided at its lower end with a tapped bore. A supporting plate 115 is screwed to the bottom of the locking block 110 by the screw 114, which can be screwed into the tapped bore.

A canlike bushing 116 is embedded and sealed in the board and has a top formed with rectangular slots which cross at right angles. The slot 117 which extends in the longitudinal direction of the loop has an opening, which is slightly larger in area than the base of the locking block 110 so that when the releasable end of the foot-retaining loop has been turned through 90° the locking block can be entirely forced through the slot 117 into the locking can 116. The slot 118 which crosses the slot 117 at right angles is horter than the slot 117 so that when the locking block 110 has been turned back through 90° said block bears on the inner edge of that slot. A pad 119 of elastic material, such as foamed rubber, lies on the bottom of the locking bushing 116 and holds the locking block 110 against the edge of the locking slot 118.

In response to a sufficiently strong tensile force acting on the foot-retaining loop in case of danger, the locking block 110 is elastically deformed and is pulled out of the slot 118 in the manner shown in FIG. 38.

The release hardness of the locking block 110 can be changed in that the screw 114 is tightened or loosened so that the backing plate 115 is more or less tightened.

A locking of the locking block 110 in the smaller slot 118 may also be effected in that its long side faces are beveled.

We claim:

1. A sailboard comprising:

a sailboard body;

a foot-retaining loop releasably connected at least at one end to said body;

a plug-in member connected to each releasable end of the foot-retaining loop;

two parallel grooves defined by the plug-in member being located on opposite sides of the plug-in member;

a bushing anchored in the sailboard body;

two resilient members located in said bushing, said resilient members adapted to lock said plug-in member in said bushing by each resilient member extending into and gripping one of said grooves;

said plug-in member being substantially round in rotational cross-section and including at least one flattened side and at least one curved side, and bearing edges located between each flattened side and each curved side, said bearing edges adapted to initiate release of the plug-in member from between the resilient members when the plug-in member is locked in said bushing, in response to at least one of a torsional, turning and twisting movement while the plug-in member is under tension.

2. A sailboard comprising;

a sailboard body;

a foot-retaining loop releasably connected at least at one end to said body;

a plug-in member connected to each releasable end of the foot-retaining loop;

two parallel grooves defined by the plug-in member being located on opposite sides of the plug-in member;

a bushing anchored in the sailboard body;

two resilient members located in said bushing, said resilient members adapted to lock said plug-in member in said bushing by each resilient member extending into and gripping one of said grooves;

said plug-in member including two first curved sections, each first curved section including one of said two grooves, two second curved sections adapted to be located between and spaced from said resilient members when the plug-in member is locked in said bushing, and four flat sections, each flat section being located between one of said first curved sections and one of said second curved sections, said flat sections adapted to initiate release of the plug-in member from between the resilient members when the plug-in member is locked in said bushing, in response to at least one of a torsional, turning and twisting movement while the plug-in member is under tension.

3. A sailboard as claimed in claim 1, wherein said two resilient members include two resilient legs of a hairpin shaped spring, said resilient legs being adjustable for variable effective lengths.

* * * * *